US006886552B2

(12) United States Patent
Cadima

(10) Patent No.: US 6,886,552 B2
(45) Date of Patent: May 3, 2005

(54) COOKTOP GRATE WITH FLAME CLEARANCE

(75) Inventor: Paul Bryan Cadima, Prospect, KY (US)

(73) Assignee: General Electric Company, Schenectady, NY (US)

( * ) Notice: Subject to any disclaimer, the term of this patent is extended or adjusted under 35 U.S.C. 154(b) by 249 days.

(21) Appl. No.: 10/065,394

(22) Filed: Oct. 11, 2002

(65) Prior Publication Data

US 2004/0069297 A1 Apr. 15, 2004

(51) Int. Cl.[7] ..... F24C 15/10

(52) U.S. Cl. ..... 126/211; 126/214 C; 126/212; 126/215; D7/408

(58) Field of Search ..... 126/214 C, 212, 126/214 D, 211, 215, 216, 214 R, 9 R, 9 B, 25 R, 40, 50, 41 R, 38, 214 A; 248/346.01; 216/432, 433, 458, 457; D7/408, 409, 407, 346; 219/432, 433, 458, 457; 99/422, 449

(56) References Cited

U.S. PATENT DOCUMENTS

| | | | | | |
|---|---|---|---|---|---|
| 218,950 | A | * | 8/1879 | Tongue, Sr. | 126/258 |
| 234,153 | A | * | 11/1880 | Walterhouse, Sr. | 126/258 |
| 560,357 | A | * | 5/1896 | Kahn | 126/214 R |
| 860,841 | A | * | 7/1907 | Symmons | 126/214 R |
| 925,255 | A | * | 6/1909 | Williams et al. | 126/258 |
| 1,032,575 | A | * | 7/1912 | Willson | 126/214 C |
| 2,005,242 | A | * | 6/1935 | Rogers | 126/39 K |
| 3,717,083 | A | * | 2/1973 | Karapetian | 99/450 |
| D244,664 | S | * | 6/1977 | Monnet | D7/337 |
| 4,029,079 | A | * | 6/1977 | Elder | 126/258 |
| 4,572,157 | A | * | 2/1986 | Napier | 126/258 |
| 4,885,989 | A | * | 12/1989 | Korpan | 99/450 |
| 4,942,864 | A | | 7/1990 | Esposito | |
| D343,336 | S | * | 1/1994 | Falk | D7/346 |
| 5,301,653 | A | * | 4/1994 | Gerdes et al. | 126/39 E |
| D353,300 | S | * | 12/1994 | Edman et al. | D7/408 |
| 5,372,121 | A | | 12/1994 | Castillo et al. | |
| 5,494,027 | A | | 2/1996 | Maughan | |
| D371,277 | S | * | 7/1996 | Pink | D7/408 |
| D378,262 | S | * | 3/1997 | Sparks | D7/408 |
| D378,885 | S | * | 4/1997 | Sparks | D7/408 |
| D389,374 | S | * | 1/1998 | Miller | D7/408 |
| 5,791,333 | A | | 8/1998 | Bennett | |
| D458,803 | S | * | 6/2002 | Becker et al. | D7/408 |
| D460,320 | S | * | 7/2002 | Becker et al. | D7/408 |
| 6,435,173 | B1 | | 8/2002 | Miller | |
| D470,359 | S | * | 2/2003 | Jones et al. | D7/408 |

FOREIGN PATENT DOCUMENTS

| | | | | |
|---|---|---|---|---|
| JP | 11347508 | A | * 12/1999 | B08B/13/00 |

* cited by examiner

*Primary Examiner*—Kathryn Odland
(74) *Attorney, Agent, or Firm*—H. Neil Houser, Esq.; Armstrong Teasdale LLP

(57) ABSTRACT

A cooktop grate includes a frame having an exterior frame element and at least one interior frame element defining a cooking utensil supporting surface. The cooking utensil supporting surface is elevated from the exterior frame element, and at least one recessed surface extends from the cooking utensil supporting surface. A top of the recessed surface is separated from a top of the cooking utensil supporting surface, thereby providing a gap for passage of a burner flame.

26 Claims, 3 Drawing Sheets

COOKTOP GRATE WITH FLAME CLEARANCE

BACKGROUND OF INVENTION

This invention relates generally to gas cooking appliances, and, more specifically, to cooktop grates for gas surface heater elements.

Gas fired cooktops typically include a flat top surface having one or more openings, with a gas burner set in each opening, and a corresponding number of raised cooking grates resting on the cooktop, generally above and surrounding the burners to provide a cooking surface spaced from the burner. Cooking implements such as pots and pans are thus placed on the stove grates above the burners to allow the flame to spread out for increasing the surface actually heated by the gas flames emanating from the burner.

Typically, cooking grates are formed from a round or square outer frame and include a number of long fingers extending radially inwardly from the outer frame. These fingers can be separate members joined at one end to an outer frame, or can be extensions of the outer frame itself. Generally, the fingers do not extend so far inward from the outer frame as to touch at the grate's center. Rather, the inner ends usually form an open area of circular shape about the burner.

An increasingly popular type of cooking grate provides a large, continuous cooking surface to support cooking implements and utensils above virtually the entire cooktop, rather than supporting them only above the vicinity of the burners. To provide the continuous supporting surface, the fingers of the grate and portions of the grate frame extending between the burners are generally coplanar so that a user may slide a cooking utensil across the supporting surface without lifting the utensil. As such, a user may slide a utensil from one burner to another, or rest the utensil in an area between the burners on a stable support surface. In use, however, cooking utensils are placed as concentric as possible over the burners when cooking, which tends to spread the burner flame outward. It has been observed that with the coplanar finger and frame portions that the flame sometimes impinges the frame, which greatly increases operating temperature of the grates and increases carbon monoxide emission from incomplete combustion of gases. Consequently, impingement of the burner flame reduces performance and operative life of the cooktop.

SUMMARY OF INVENTION

In one aspect, a cooking grate is provided. The grate comprises a frame comprising an exterior frame element, at least one interior frame element comprising a cooking utensil supporting surface, said cooking utensil supporting surface elevated from said exterior frame element, and at least one recessed surface extending from said cooking utensil supporting surface, a top of said recessed surface separated from a top of said cooking utensil supporting surface, thereby providing a gap for passage of a burner flame.

In another aspect, a grate assembly for a gas cooking appliance is provided. The grate assembly comprises at least one exterior frame element and at least one support finger extending from said frame, said support finger comprising a top surface extending above said at least one exterior frame element. At least one interior frame element comprising a top surface extending above said at least one exterior frame element, and the top surface of said interior frame element substantially coplanar with said top surface of said support finger. At least one recessed surface extends from said top surface of said interior frame element, and the recessed surface defines a clearance for passage of a burner flame.

In another aspect, a grate assembly for a gas cooktop is provided. The grate assembly comprises at least one grate section comprising a substantially rectangular frame comprising at least one exterior frame element comprising a top surface , at least one interior frame element comprising a top surface, and a cross member frame element comprising a top surface. The cross member frame element extends between said exterior frame element and said interior frame element, and the top surfaces of said interior cross member frame element and said interior frame element are substantially coplanar and elevated relative to a top surface of said exterior frame element. At least one of said cross member frame element and said interior frame element comprise a recessed surface extending from said coplanar surface, said recessed surface comprising a flame clearance gap.

In another aspect, a gas fired cooktop is provided. The cooktop comprises at least a first gas burner and a second gas burner, and a grate assembly surrounding said first gas burner and said second gas burner. The grate assembly comprises an interior frame element extending between said first gas burner and said second gas burner, and the interior frame element comprises a cooking utensil surface and a flame clearance recessed portion extending from said cooking utensil surface.

In still another aspect, a gas fired cooktop is provided. The cooktop comprises a first gas burner and an adjacent second gas burner, and a first grate section surrounding said first and second gas burners. The cooktop also comprises a third gas burner and an adjacent fourth gas burner, the third and fourth gas burners adjacent said first and second gas burners, and a second grate section surrounding said third and fourth gas burners. A bridge spacer grate section extends between said first grate section and said second grate section. A top surface of each of said first grate section, second grate section, and bridge spacer section comprise a substantially coplanar utensil supporting surface, and a recessed surface portion extending from said utensil supporting surface between each adjacent gas burner.

DETAILED DESCRIPTION

Figure 1:
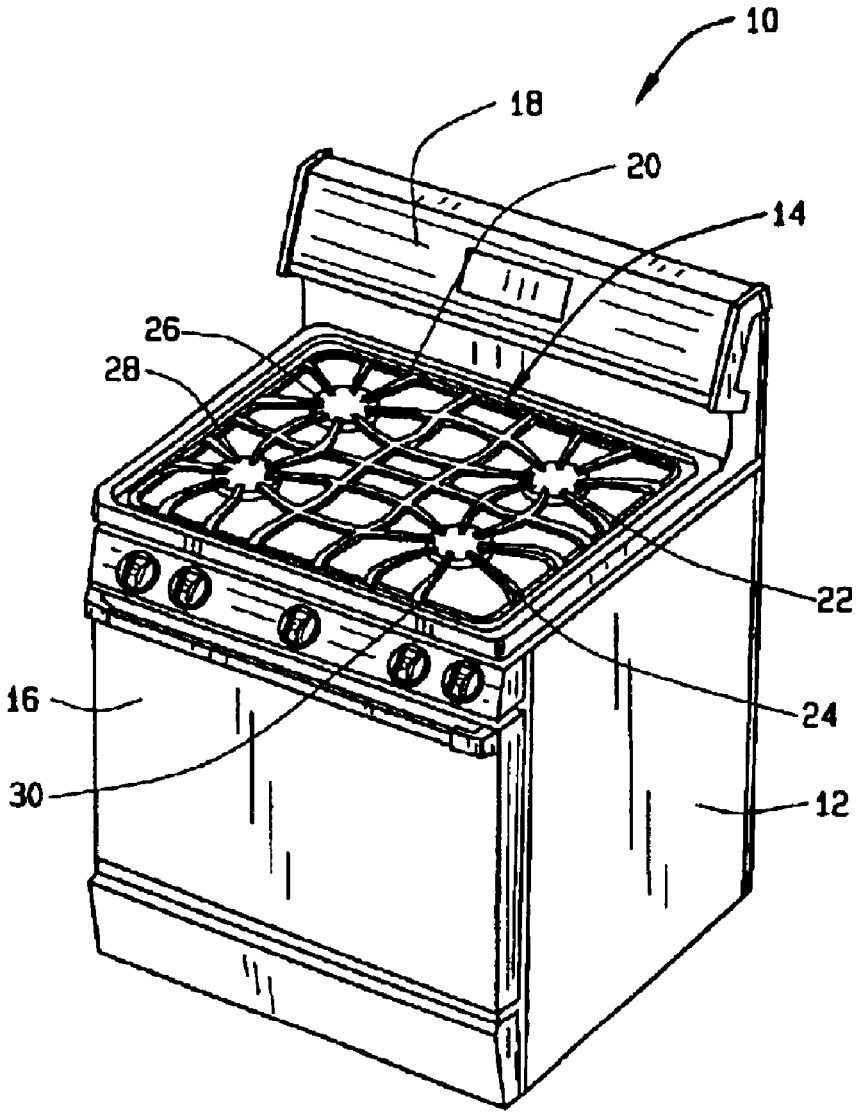
FIG. 1 illustrates an exemplary free standing gas range.

FIG. 1 illustrates a gas cooking appliance in the form of a free standing gas range 10 including an outer body or cabinet 12 that incorporates a generally rectangular cooktop 14. An oven, not shown, is positioned below cooktop 14 and has a front-opening access door 16. A range backsplash 18 extends upward of a rear edge 20 of cooktop 14 and includes, for example, a control display and control selectors for user manipulation to select operative oven features, cooking timers, time and temperature displays, etc. It is contemplated that the present invention is applicable, not only to cooktops which form the upper portion of a range, such as range 10, but to other forms of cooktops as well, such as, but not limited to, built-in counter units that are mounted to kitchen counters. Therefore, gas range 10 is provided by way of illustration rather than limitation, and accordingly there is no intention to limit application of the present invention to any particular appliance or cooktop, such as range 10 or cooktop 14. In addition, it is contemplated that the present invention is applicable to multiple fuel cooking appliances, e.g., a gas cooktop with an electric oven or other combination of gas, electric, or other types of heating elements.

In an exemplary embodiment, cooktop 14 includes four gas fueled burners 22, 24, 26, 28 which are positioned in spaced apart pairs 22, 24 and 26, 28 positioned adjacent each side of cooktop 14. Each pair of burners 22, 24 and 26, 28 is surrounded by a recessed area (not shown in FIG. 1) respectively, of cooktop 14. The recessed areas are positioned below the upper surface 30 of cooktop 14 and serve to catch spills from cooking utensils being used with cooktop 14. Each burner 22, 24, 26, 28 extends upwardly through an opening in cooktop 14, and a grate assembly 30 is positioned over burners, 22, 24, 26, 28 and substantially spans cooktop 14. The construction and operation of the range heating elements, including cooktop gas burners 22, 24, 26, 28 are believed to be within the purview of those in the art without further discussion. It is appreciated that greater or fewer than four burners could be employed in alternative embodiments of the invention, with or without associated recessed areas in the cooktop associated with the burners.

Grate assembly 30 includes a number of utensil supporting fingers extending toward and between burners 22, 24, 26 and 28, and each of the fingers include a substantially flat top surface coplanar with the top surfaces of the other fingers to support cooking utensils and implements thereon. Additionally, and as explained further below, grate assembly 30 further includes interior frame members extending between the burners, and each of the interior frame members includes a top surface substantially coplanar with the top surface of the fingers. The interior frame members provide additional support surfaces between burner pairs 22, 24 and 26, 28 for placement of cooking utensils (e.g., pots and pans). Thus, grate assembly 30 provides an extended area over cooktop 14 for placement of cooking utensils thereon, including an area between burners 22, 24, 26, 28. Additionally, cooking utensils may be slid across the top surface of grate assembly 30 to any desired position on the surface of the grate without lifting the utensils.

However, unlike known grate assemblies providing an extended cooking utensil support surface, grate assembly 30 is constructed to significantly reduce, if not avoid, impingement of a burner flame on a surface of the grate. As will become apparent below, grate assembly 30 provides strategically located recessed surfaces extending from the utensil supporting surfaces. The recessed surfaces provide a clearance for a burner flame to pass therethrough, effectively reducing, if not avoiding, impingement of a surface of grate assembly 30. Operating temperatures of grate 30 are therefore reduced and associated carbon monoxide emissions are likewise reduced, thereby providing a more efficient cooking environment.

Figure 2:
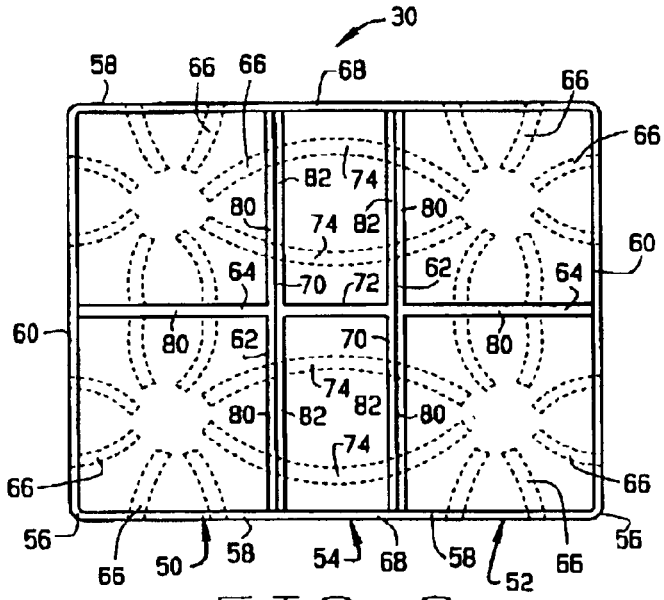
FIG. 2 is a top plan view of a grate assembly for the range shown in FIG. 1.

FIG. 2 is a top plan view of an exemplary grate assembly 30 including a first grate section 50, a second grate section 52, and a spacer bridge section 54 extending between and adjacent each of grate sections 50, 52. In use, grate section 50 overlies a first pair of cooktop burners (such as burners 26, 28 of cooktop 14 shown in FIG. 1) and grate section 52 overlies a second pair of burners (such as burners 22, 24 of cooktop 14). Bridge spacer section 54 extends between grate sections 50, 52 and between associated pairs of burners on a cooktop, such as cooktop 14.

In an exemplary embodiment, each of grate sections 50, 52 are substantially identically constructed, mirror images of one another, and each section 50, 52 includes a frame 56 for surrounding burner elements on cooktop 14. As illustrated in FIG. 2, frames 56 are substantially rectangular, although it is appreciated that frames 56 need not be rectangular in alternative embodiments to achieve the advantages and benefits of the present invention.

More particularly, frames 56 include opposite lateral exterior frame elements 58, an exterior longitudinal frame element 60 extending between lateral frame elements 58, and an interior longitudinal frame element 62 extending between lateral frame elements 58 in a box-like rectangular configuration. As used herein, interior and exterior refer to relative positions in the overall grate assembly 30 with exterior referring to outer edges of the overall assembly 30 and interior referring to elements extending from and/or between the outer edges of the overall assembly 30. In an illustrative embodiment, lateral exterior frame elements 58 extend substantially parallel to one another, and exterior and interior longitudinal frame elements 60, 62 extend substantially perpendicular to lateral exterior frame elements 58 from opposite ends thereof. An interior cross member frame element 64 substantially bisects longitudinal frame elements 60, 62 and therefore divides frames 56 into approximately equal halves. In an exemplary embodiment, each of the frame halves is substantially square and is dimensioned to surround one of the gas cooktop burners.

A plurality of support fingers 66 (shown in phantom in FIG. 1) extend inwardly from frame elements 58, 60, 62, 64 toward a center of each of the frame halves for supporting a cooking utensil above cooktop 14. As illustrated in FIG. 2, two support fingers 66 extend from each of frame elements 58, 60, 62, 64 for a total of eight support fingers 66 in each half of frames 56. As illustrated in FIG. 2, each support finger 66 is curved and extends inward to a center of each half of frame 56 in the form of an elliptical arc, providing a spider-like appearance to each half of frame 56. It is recognized, however, that a wide variety of finger shapes could likewise be used in alternative embodiments of the invention. Further, it is contemplated that greater or fewer numbers of support fingers 66 may be employed in alternative embodiments without departing from the scope of the present invention.

In an illustrative embodiment, spacer bridge section 54 is substantially rectangular but of a smaller lateral dimension than grate sections 50, 52. More particularly, spacer bridge section 54 includes opposite lateral exterior frame elements 68 extending substantially parallel to one another, and opposite interior longitudinal frame elements 70 extending substantially parallel to one another from opposite ends of lateral frame elements 68 and substantially perpendicular to lateral exterior frame elements 68. An interior cross member frame element 72 substantially bisects longitudinal frame elements 70 and therefore divides spacer bridge section 54 into approximately equal halves. Support fingers or elements 74 extend from and between lateral exterior frame elements 68 on either side of interior cross member frame element 72.

In an illustrative embodiment, two support members 74 are included on each side of cross member element 72 for a total of four support elements 74 in spacer bridge section 54.

Additionally, and as illustrated in FIG. 2, support members 74 are oppositely curved and extend between longitudinal frame elements 70 in an elliptical arc. It is contemplated, however, that greater or fewer numbers of support members 74, and further that other shapes of support members 74 and frame elements 68, 70, 72 may be employed in alternative embodiments of the invention while achieving the benefits of the instant invention.

In an exemplary embodiment, and as illustrated in FIG. 2, when grate assembly 30 is employed on a cooktop, such as cooktop 14 (shown in FIG. 1), interior longitudinal frame elements 62 of grate sections 50, 52 are abutted against interior longitudinal frame elements 70 of spacer bridge section 54. Lateral exterior frame elements 68 of bridge spacer section 54 are generally aligned with lateral exterior frame elements 58 of grate sections 50, 52, and cross member element 72 of bridge spacer section 54 is generally aligned with cross member elements 64 of grate sections 50, 52. In addition, support members 74 of bridge spacer section 54 share a curvature of support fingers 66 extending from interior longitudinal frame elements 62 of grate sections 50, 52. An intersecting elliptical pattern is therefore created throughout grate assembly 30.

Grate section support fingers 66 and interior frame elements 62 and cross member 64 of each grate section 50, 52 are elevated from exterior frame elements 58, 60. Thus, when exterior frame elements 58, 60 are placed on a cooktop, fingers 66 and interior frame elements 62, 64 extend above the cooktop and above gas burners in the cooktop, such as burners 22, 24, 26, and 28 (shown in FIG. 1). In addition, support fingers 66 and interior frame elements 62, 64 include generally coplanar top surfaces except in recessed portions 80 that reduce, if not avoid, instances of a burner flame impinging directly on a surface of grate assembly 30.

Likewise, bridge spacer section support elements 74, interior frame elements 70, and cross member 72 are elevated from exterior frame elements 68 so that when exterior frame elements 68 are placed on a cooktop, elements 70, 72, and 74 extend above the cooktop between grate sections 50, 52. In addition, elements 70, 72, 74 include generally coplanar top surfaces except in recessed portions 82 that reduce, if not avoid, instances of a burner flame impinging directly on a surface of grate assembly 30.

As seen in FIG. 2, recessed portions 80 are located on interior frame elements 62, 64 and are approximately centered therein relative to the frame halves of each grate section 50, 52. As such, the recessed portions 80 are generally positioned between burner elements when grate assembly 30 is used. In a four burner system, such as in cooktop 14 shown in FIG. 1, three recessed portions 80 are employed in each grate section 50, 52 (i.e., one recessed portion 80 in cross member 64 and two recessed portions 80 in interior longitudinal element 62). Also, as seen in FIG. 2, in a four burner system bridge spacer section 54 includes two recessed portions 82 on each interior longitudinal frame element 70 that are substantially aligned with recessed portions 80 in grate section longitudinal elements 62.

By locating recessed portions 80, 82 in approximately the center of the interior frame elements of grate sections 50, 52, interference between the interior frame elements and a burner flame is reduce, if not avoided as the burner flame is extended radially outwardly by a cooking utensil. Recessed portions 80, 82 provide a clearance or air gap between a bottom surface of a cooking utensil and a top surface of recessed portions 80, 82 for passage of burner flames, thereby reducing contact of burner flames with a surface of the grate. An operating temperature of grate assembly 30 is therefore lowered, grate life is increased, and carbon monoxide emissions are reduced.

Figure 3:
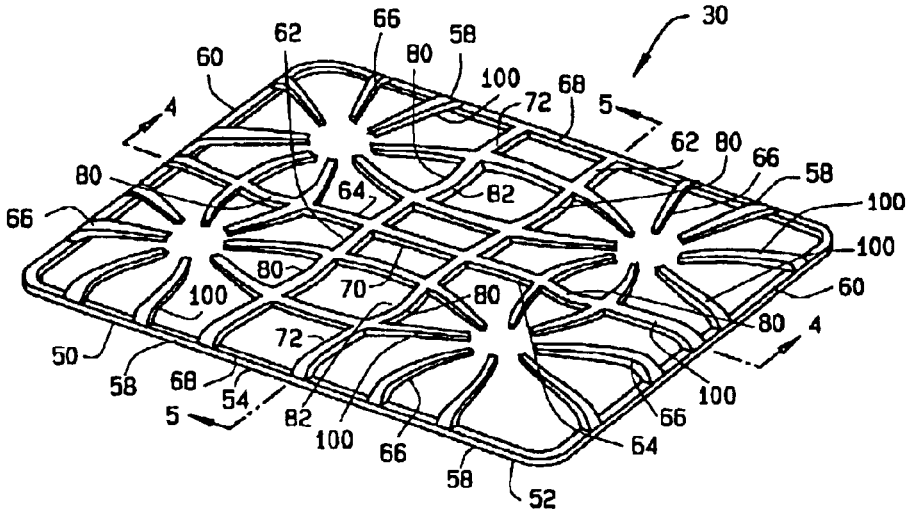
FIG. 3 is a perspective view of the grate assembly shown in FIG. 2.

FIG. 3 is a perspective view of grate assembly 30 illustrating support fingers 66 and interior frame elements 62, 64 of grate sections 50, 52 extending upwardly above grate section exterior elements 58, 60. Likewise interior frame elements 70, 72 and support elements 74 of bridge spacer section 54 extend upwardly from and above exterior frame elements 68. The elevated elements form a substantially coplanar cooking utensil support surface 100 on top surfaces thereof, and recessed portions 80, 82 extend downwardly from support surface 100 to provide a clearance for burner flames in the interior elements of grate assembly 30 between adjacent burners.

Figure 4:
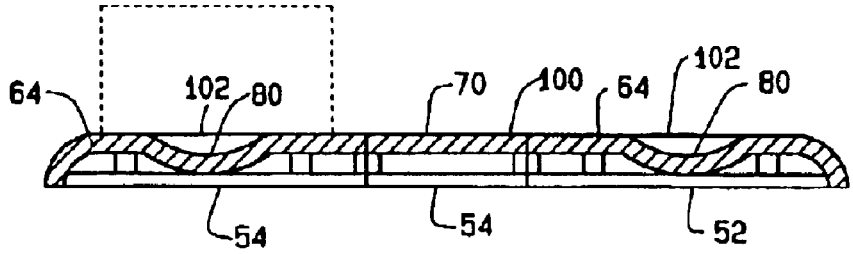
FIG. 4 is a cross-sectional view of the grate assembly shown in FIG. 3 along line 4—4.

FIG. 4 is a cross-sectional view of grate assembly 30 through cross member elements 64, 70 of grate sections 50, 52 and bridge spacer sections 54, respectively. Recessed portions 80 are curved downwardly in a concave form beneath utensil supporting surface 100, thereby creating a clearance or gap 102 between a top surface of recessed portion 80 and utensil supporting surface 100. Clearance 102 accommodates radially extending burner flames that would otherwise interfere with cross member elements 64. Specifically, flames may pass through clearances 102 with less interference with the grate assembly 30.

While in the illustrated embodiment clearances 102 are formed via concave recessed portions 80, recessed portions 80 in alternative embodiments may assume a variety of other shapes, including but not limited to flat or linear surfaces to provide the flame clearance function described above.

Figure 5:
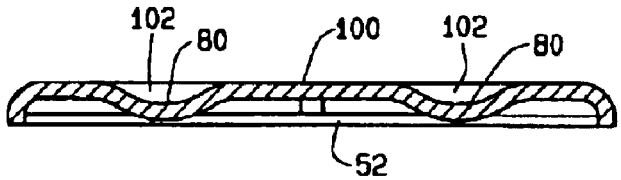
FIG. 5 is a cross-sectional view of the grate assembly shown in FIG. 3 along line 5—5.

FIG. 5 is a cross-sectional view of grate assembly 30 through longitudinal interior frame elements 62 of grate assembly 52. Recessed portions 80 are curved downwardly in a concave form beneath utensil supporting surface 100, thereby creating a clearance or gap 102 between a top surface of recessed portion 80 and utensil supporting surface 100. Clearance 102 accommodates radially extending burner flames that would otherwise interfere with cross member elements 64. Specifically, flames may pass through clearances 102 with less interference with grate assembly 30.

It is therefore evident that longitudinal and lateral clearances are provided to accommodate burner flames extending radially from a gas burner element. As clearances 102 substantially reduce impingement of flames upon surfaces of grate assembly 30 in use, substantially lower operating temperatures are experienced by grate assembly 30. Further, incomplete combustion of fuel and emission of carbon monoxide attributable to impingement of a burner flame on the grate assembly is substantially reduced.

It is recognized that in alternative embodiments clearances 102 may be provided longitudinally between burner elements (i.e., between front and back burners) without providing lateral clearances (i.e., clearances between left and right burners, or vice versa. Moreover, it is contemplated that the present invention is applicable to grates having interior and exterior frame elements in the same plane, as opposed to the above-described embodiments wherein exterior frame elements are lower than interior frame elements.

While the invention has been described in terms of various specific embodiments, those skilled in the art will recognize that the invention can be practiced with modification within the spirit and scope of the claims.

What is claimed is:

1. A cooking grate comprising:

a frame comprising an exterior frame element;

at least one interior frame element comprising a cooking utensil supporting surface, said cooking utensil supporting surface elevated from said exterior frame element;

at least one recessed surface extending from said cooking utensil supporting surface, a top of said recessed surface separated from a top of said cooking utensil supporting surface, thereby providing a gap for passage of a burner flame;

at least one cross member frame element comprising a top surface, said top surface substantially coplanar with said cooking utensil supporting surface, each said cross member frame element extending between and attached to said exterior frame element and said at least one interior frame element; and at least one support finger extending from at least one of said exterior frame element and interior frame element, each said support finger comprising a first end and a second end, said first end attached to said exterior frame element or said interior frame element, said second end unattached.

2. A cooking grate in accordance with claim 1, said grate comprising a first interior element and a second interior element, each of said first interior element and said second interior element comprising a recessed surface.

3. A cooking grate in accordance with claim 1 further comprising a plurality of support fingers extending from said interior frame element and said exterior frame element.

4. A cooking grate in accordance with claim 3 wherein said support fingers comprise elliptical arcs.

5. A cooking grate in accordance with claim 1 wherein said cooking grate is substantially rectangular.

6. A grate assembly for a gas cooking appliance, said grate assembly comprising:

at least one exterior frame element;

at least one support finger extending from said exterior frame, said support finger comprising a top surface extending above said at least one exterior frame element, each said support finger comprising a first end and a second end, said first end attached to said exterior frame element, said second end unattached;

at least one interior frame element comprising a top surface extending above said at least one exterior frame element, said top surface of said interior frame element substantially coplanar with said top surface of said support finger;

at least one cross member frame element comprising a top surface, said top surface substantially coplanar with said top surface of said at least one interior frame element, each said cross member frame element extending between and attached to said exterior frame element and said at least one interior frame element; and at least one recessed surface extending from said top surface of said interior frame element, said recessed surface defining a clearance for passage of a burner flame.

7. A grate assembly in accordance with claim 6, said assembly comprising a first grate section, a second grate section, and a bridge spacer section.

8. A grate assembly in accordance with claim 7 wherein at least one of said first grate section and said second grate section comprises a cross member frame element substantially dividing said grate section, said at least one recessed surface located in said cross member frame element.

9. A grate assembly in accordance with claim 6 wherein said at least one interior frame element comprises a first recessed surface and a second recessed surface.

10. A grate assembly in accordance with claim 6 wherein said grate assembly is substantially rectangular.

11. A grate assembly for a gas cooktop, said grate assembly comprising:

at least one grate section, each said grate section comprising a substantially rectangular frame comprising:

at least one exterior frame element comprising a top surface;

at least one interior frame element comprising a top surface; and a cross member frame element comprising a top surface, said cross member frame element extending between and attached to said exterior frame element and said interior frame element, said top surfaces of said cross member frame element and said interior frame element substantially coplanar and elevated relative to a top surface of said exterior frame element; and at least one of said cross member frame element and said interior frame element comprising a recessed surface extending from said coplanar surface, said recessed surface comprising a flame clearance gap.

12. A grate assembly in accordance with claim 11, said recessed surface approximately centered in said cross member frame element.

13. A grate assembly in accordance with claim 11 wherein said interior frame element comprises a first recessed portion and a second recessed portion, said first recessed portion and said second recessed portion located on opposite sides of said cross member.

14. A grate assembly in accordance with claim 11 further comprising at least one support finger extending from said frame, said support finger extending in an elliptical arc.

15. A grate assembly in accordance with claim 11 further comprising a bridge spacer section comprising a top surface coplanar with said top surface of said interior frame element, and at least one recessed portion extending from said top surface of said bridge spacer section.

16. A grate assembly in accordance with claim 15 wherein said recessed surface is concave.

17. A gas fired cooktop comprising:

at least a first gas burner and a second gas burner; and a grate assembly surrounding said first gas burner and said second gas burner, said grate assembly comprising an exterior frame element, an interior frame element extending between said first gas burner and said second gas burner, and a cross member fame element extending between and attached to said exterior frame element and said interior frame element, said interior frame element and said cross member frame element comprising a cooking utensil surface and a flame clearance recessed portion extending from said cooking utensil surface.

18. A cooktop in accordance with claim 17 wherein said grate assembly comprises a rectangular grate section surrounding said first burner and said second burner.

19. A cooktop in accordance with claim 18 wherein said cooktop comprises four burners, said grate assembly comprising a first grate section, a second grate section, and a bridge spacer section therebetween.

20. A cooktop in accordance with claim 18 wherein said recessed portion substantially centered in said cross member frame element.

21. A cooktop in accordance with claim 20 wherein said recess portion is concave.

22. A gas fired cooktop comprising:

a first gas burner and an adjacent second gas burner;

a first grate section surrounding said first and second gas burners;

a third gas burner and an adjacent fourth gas burner, said third and fourth gas burners adjacent said first and second gas burners;

a second grate section surrounding said third and fourth gas burners;

a bridge spacer grate section extending between said first grate section and said second grate section; a top surface of each of said first grate section, second grate section, and bridge spacer section comprising a substantially coplanar utensil supporting surface; and a recessed surface portion extending from said utensil supporting surface between each adjacent gas burners;

said first and said second grate sections comprising:

a frame comprising an exterior frame element;

at least one interior frame element comprising a top surface substantially coplanar with said cooking utensil supporting surface, said cooking utensil supporting surface elevated from said exterior frame element; and at least one cross member frame element comprising a top surface, said top surface substantially coplanar with said cooking utensil supporting surface, each said cross member frame element extending between and attached to said exterior frame element and said at least one interior frame element.

23. A cooktop in accordance with claim 22 wherein said recessed surface portion is substantially centered between each adjacent burner in said first and second grate section.

24. A cooktop in accordance with claim 23 wherein at least one of said first and second grate sections is substantially rectangular.

25. A cooktop in accordance with claim 22 further comprising a plurality of elliptically extending support fingers extending from each of said first grate, second grate and said bridge spacer section.

26. A cooktop in accordance with claim 22 wherein said recessed portion is concave.

* * * * *